US007850394B2

(12) United States Patent
Schröder

(10) Patent No.: US 7,850,394 B2
(45) Date of Patent: Dec. 14, 2010

(54) PAVING STONE

(76) Inventor: Harald Schröder, Monheimsallee 75, Aachen (DE)

( * ) Notice: Subject to any disclaimer, the term of this patent is extended or adjusted under 35 U.S.C. 154(b) by 0 days.

(21) Appl. No.: 11/659,159

(22) PCT Filed: Jul. 26, 2005

(86) PCT No.: PCT/EP2005/008107

§ 371 (c)(1),
(2), (4) Date: Sep. 4, 2008

(87) PCT Pub. No.: WO2006/015720

PCT Pub. Date: Feb. 16, 2006

(65) Prior Publication Data

US 2009/0097916 A1 Apr. 16, 2009

(30) Foreign Application Priority Data

Aug. 2, 2004 (EP) ..... 04018271

(51) Int. Cl.
*E01C 5/00* (2006.01)
*E04C 2/04* (2006.01)

(52) U.S. Cl. ..... 404/38; 404/34; 404/37; 52/603

(58) Field of Classification Search ..... 404/37, 404/38, 40, 41; 52/596, 603–605
See application file for complete search history.

(56) References Cited

U.S. PATENT DOCUMENTS

| | | | | | |
|---|---|---|---|---|---|
| 872,003 | A * | 11/1907 | Morgan | 52/509 |
| 3,464,328 | A * | 9/1969 | Van Meijden | 404/41 |
| 5,224,792 | A * | 7/1993 | Hagenah | 404/39 |
| 5,503,498 | A * | 4/1996 | Scheiwiller | 404/34 |
| 5,902,069 | A * | 5/1999 | Barth et al. | 404/34 |
| 6,055,784 | A * | 5/2000 | Geiger | 52/302.1 |
| 6,857,244 | B2 * | 2/2005 | Schmitz | 52/596 |
| 7,220,078 | B2 * | 5/2007 | Drost et al. | 404/38 |

FOREIGN PATENT DOCUMENTS

| | | | |
|---|---|---|---|
| DE | 20109608 | | 1/2002 |
| DE | 29924540 | | 12/2003 |
| EP | 1024226 | A1 * | 8/2000 |
| EP | 1036882 | | 9/2000 |
| EP | 1050624 | * | 11/2000 |

* cited by examiner

*Primary Examiner*—Thomas B Will
*Assistant Examiner*—Abigail A Risic
(74) *Attorney, Agent, or Firm*—Andrew Wilford

(57) ABSTRACT

A polygonal paving stone has a plurality of substantially planar sides extending perpendicularly between parallel upper and lower faces of the stone. A row of substantially identical and outwardly projecting narrow coupling members of a predetermined member width on each of the sides are separated by spaces of a predetermined space width. These narrow members are positioned on the respective sides such that when a plurality of the paving stones are fitted together with their upper faces generally coplanar the narrow coupling members of confronting sides of adjacent paving stones fit between one another A single wide coupling member on each of the sides has a width a greater than that of the member width of the narrow members and smaller than the space width so it can fit between two of the narrow members of a confronting side of an adjacent paving stone.

9 Claims, 4 Drawing Sheets

Fig. 1
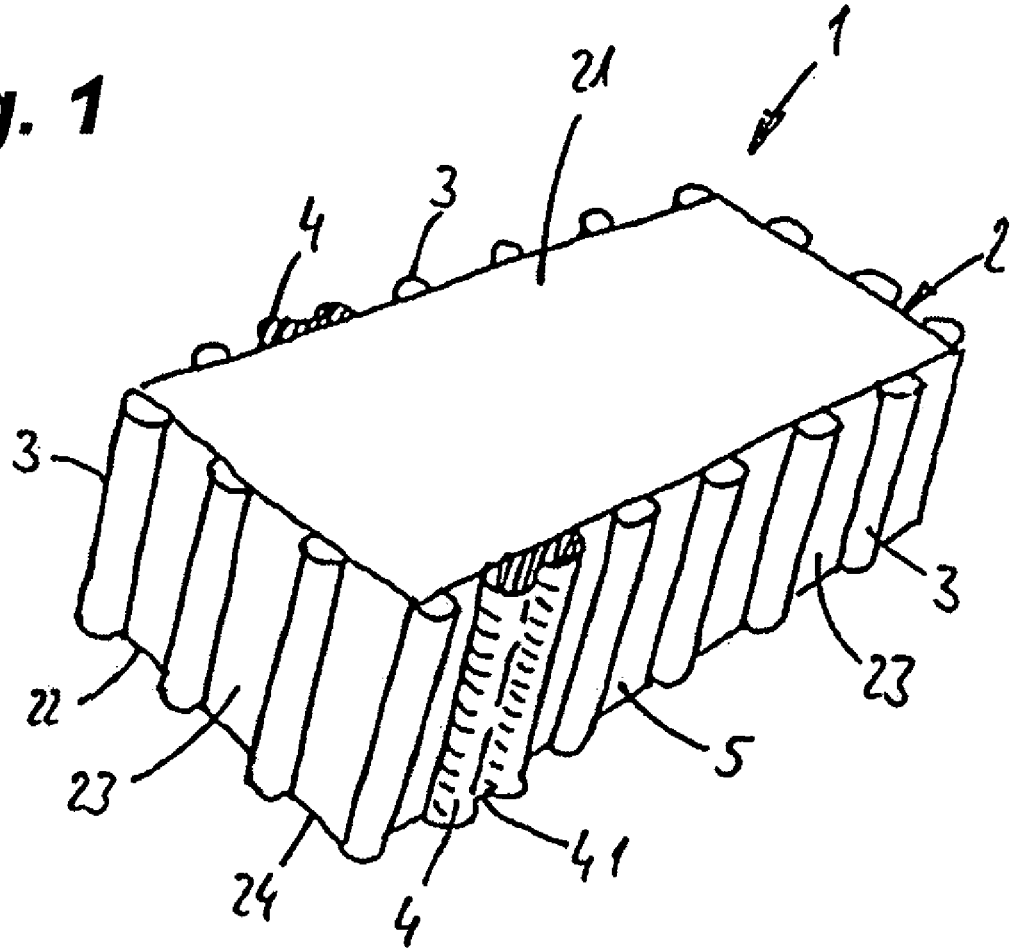
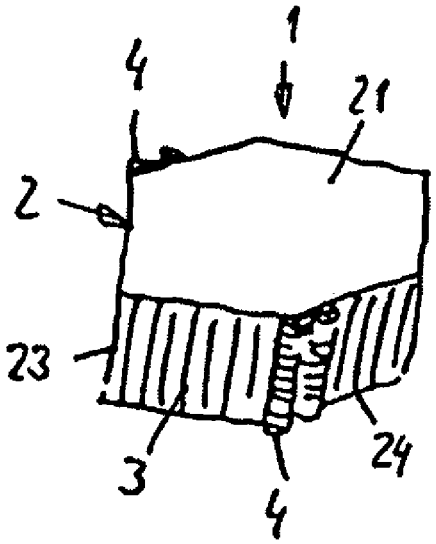
Fig. 2
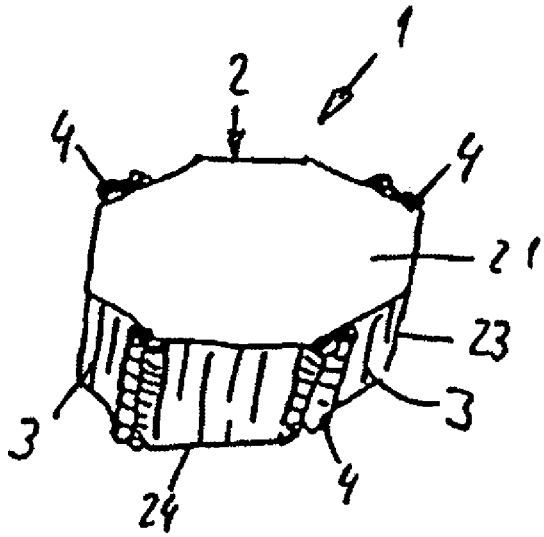
Fig. 3

PAVING STONE

CROSS REFERENCE TO RELATED APPLICATIONS

This application is the US national phase of PCT application PCT/EP2005/008107, filed 26 Jul. 2005, published 16 Feb. 2006 as WO2006/015720, and claiming the priority of European patent application 04018271.9 itself filed 2 Aug. 2004, whose entire disclosures are herewith incorporated by reference.

FIELD OF THE INVENTION

The invention is directed to a paving stone with side flanks preferably directed perpendicularly with respect to the laying plane, the paving stone having at least two coupling members with different widths at least one side flank, which coupling members fit complementarily with the coupling members of an adjacent stone.

BACKGROUND OF THE INVENTION

Paving stones, especially for the construction of roads, are often realized as coupling systems on account of the security against displacement. These coupling systems are based on the principle that coupling members on one stone flank in the basic grid engage into the spaces of the coupling members disposed in the basic grid on the flank of the adjacent stone and prevent displacement of the stones with respect to one another in cooperation with the filling of the joints. In common use is the so-called "revolving system" according to which the coupling members are disposed on all side flanks of the paving stone diametrically and engage into one another in a predetermined basic grid on all sides independently of the position of the stones with respect to one another. According to this system the stones have a defined upper face and lower face. When laying the paving stones it is critical that the stones have no contact with one another, if possible, and are rather separated from one another by joint material. By this it is guaranteed that no damage to the pavement structure on account of temperature variations and material expansions in connection therewith can occur. However, in practice one can frequently observe that the laying is done stone by stone since this is faster and more economical for the first view.

For avoiding this disadvantage it is known from EP 1 036 882 to provide artificial stones for paving purposes with coupling portions having spacers that set a minimum distance between the stones/coupling members. The area for contacting an adjacent stone is so small that it secures the ideal position of the stone with the desired joint spacing during laying, however, is at least partly destroyed during jarring of the laid pavement. It is a disadvantage of the pre-known systems that they cannot be applied to stones with larger dimensional tolerances (for instance to clinker bricks made of baked clay). The reason for this is that the coupling members no longer engage into one another with larger dimensional differences of the stones. Accordingly, the interengagement necessary for coupling is not obtained. If the spacing between the coupling members is selected so large that the necessary tolerance with different size stones is given this results in an excessive laying clearance which results in laying mistakes in practice. The sum of smaller dimensional tolerance errors throughout several stones results in leaving the coupling grid which can result in a degradation or even in a loss of the necessary coupling effect.

OBJECT OF THE INVENTION

The object of the invention is to remove this difficulty. It is also the object of the invention to provide a paving stone with coupling system as security against displacement in the pavement structure upon horizontally occurring forces which fulfils this function even with larger dimensional tolerances of the stones, as for instance with clinker bricks made from baked clay, and minimizes the possibility of a direct contact between the laid stones.

SUMMARY OF THE INVENTION

According to the invention this object is achieved by the is feature that at least one coupling member has a width which substantially corresponds to the spacing between two adjacent coupling members of an adjacent paving stone.

With the invention a paving stone with coupling system as security against displacements in the pavement structure upon horizontally occurring force has been provided which fulfils this function even with larger dimensional tolerances of the stones, as for instance with clinkers made of baked clay, and which minimizes the possibilities for a direct contact between the laid stones.

A point-by-point fixation of the adjacent stones with respect to one another is achieved by the wide design in relation to known coupling member. In this manner dimensional differences or laying mistakes are prevented from adding up across several stones and thus endangering the coupling system. A network of fixation points is generated throughout the whole laying area as substantial element of the coupling effect. The dimensional differences of individual stones cannot add themselves throughout the area and endanger the coupling effect. Small individual mistakes within the fixation network are taken up in the next joint. As a result, the joints can slightly vary in width without endangering the coupling effect thereby. Simultaneously, the wide coupling members acting as fixation elements allow wide chambers for receiving coarser and more effective joint materials in the joints without generating thereby the danger of serious laying mistakes. Furthermore, the use of these fixation elements makes sense also with coupling systems without special requirements since the lateral fixation of the stones with respect to one another is reduced to the absolute minimum of contact edges. The construction of molds is also simplified thereby and is especially economical.

According to a further feature of the invention two opposite side flanks have the same number of wide coupling members and preferably each flank includes one coupling member and the wide coupling members of opposite flanks are directly across from each other. This way, a uniform coupling pavement without displacement mistakes is enabled.

According to an embodiment of the invention at least one wide coupling member forms a cavity. This cavity captures necessarily moved bedding Material which acts then as buffer between the stones. This way, contact between two adjacent stones is further counteracted.

Preferably, the paving stone includes at least one lower edge which is sharp. This assists a uniform packing of the bedding material.

According to another embodiment of the invention at least one space between two narrow coupling members is provided with a depth-reducing thickening. This thickening also counteracts a surface contact between two adjacent stones.

According to another embodiment of the invention the space between two coupling members is significantly larger than the width of a narrow coupling member. As a result, further clearances between the coupling members are provided which, for instance, are necessary with stones having larger dimensional differences or is which can be desired if coarser joint material is present.

BRIEF DESCRIPTION OF THE DRAWING

Other developments and embodiments of the invention are indicated in the remaining subclaims. Examples of the invention are shown in the drawing and are described in detail in the following. Of the drawings FIG. 1 is a perspective representation of a paving stone of rectangular shape;

FIG. 2 is a perspective representation of a paving stone of hexagonal shape;

FIG. 3 is a perspective representation of a paving stone of octagonal shape;

SPECIFIC DESCRIPTION

Figure 4:
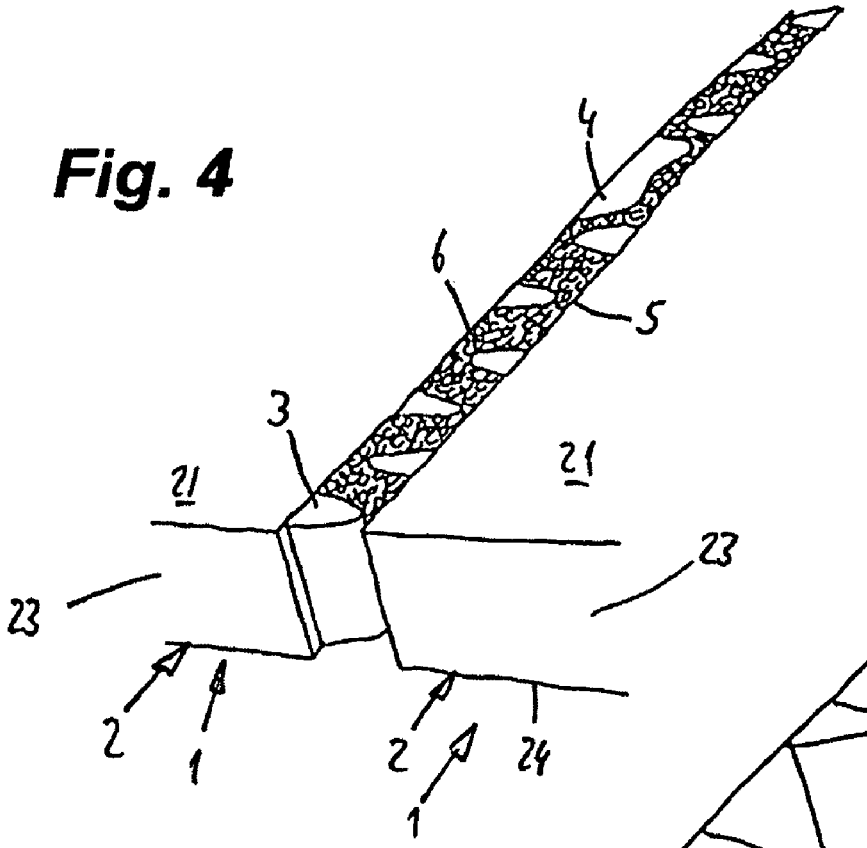
FIG. 4 shows the coupling of two adjacent paving stones.

The paving stone 1 selected as example is made of concrete, clinker, baked clay or other materials usable for pavement surfaces. The paving stone 1 consists of a basic body 2 with coupling members 3 and 4. According to the example of FIGS. 1 and 4 to 7 the paving stone 1 has the shape of a right parallelepiped. According to the example of FIG. 2 the paving stone 1 has a hexagonal shape. In the example of FIG. 3 the paving stone 1 has an octagonal shape. Other designs of the paving stones are also possible.

The basic body 2 has an upper face 21 on which one can walk and over which one can drive, a lower face 22 facing the ground and side flanks 23 formed between the upper face and the lower face. The lower face 22 is limited by a sharp lower peripheral edge 24.

Vertical, narrow coupling members 3 are equidistantly spaced on the side flanks 23 of the paving stone 1 according to FIG. 1. The coupling members 3 are substantially semicylindrical. One or more coupling members 3 can be formed with a greater horizontal depth and thus can serve as projecting spacers. A wide coupling member 4 is provided adjacent the end of the paving stone 1 on each of the two side flanks 23 of the long sides substantially diametrally across from each other. In the example the coupling member 4 has substantially the width of two coupling members 3. A cavity 41 is formed within the coupling member 4 along its vertical axis. This cavity 41 is of substantially semicylindrical section.

The paving stones 1 according to the examples of FIGS. 2 and 3 also consist of a basic body 2 and have upper faces 21 and lower faces 22 and side flanks 23 formed therebetween. A sharp lower edge 24 is also provided. The paving stones 1 according to FIGS. 2 and 3 have also coupling members 3 and 4 which are formed like the coupling members of the example according to FIG. 1. In the example of FIG. 2 the wide coupling members 4 are provided diametrically across from one another on two side flanks 23 which are parallel to one another. In contrast to this the example of FIG. 3 has four wide coupling members 4 of which two are also disposed in a diametrically opposing manner on two parallel side flanks 23.

When two paving stones 1 are coupled the coupling members 3, 4 of the one paving stone project into the spaces 5 of the adjacent paving stone formed by the respective coupling members 3, 4. Filling material 6 (for instance sand or stone chips) has been filled into the spaces 5 (compare FIG. 4). In the cavity 41 of the wide coupling member 4 so much filling material 6 is accumulated that the two paving stones have a sufficient spacing from one another so that the coupling members 3 do not contact the edges of the spaces 5 of the respective adjacent paving stone. The wide coupling member 4 is dimensioned in such a manner that it substantially fills the whole space of the coupling members 3 formed on both sides of the coupling member 4 on the adjacent stone, i.e. the width of the coupling member 4 substantially corresponds with its area engaging the side flank 23 to the clear spacing between two adjacent coupling members 3, 4. A securing of the position of the stones with respect to one another is obtained between possible contact lines between the wide coupling member 4 of the one paving stone and the two coupling members 3 of the adjacent paving stone. As a result, the two stones are secured relative to one another against displacement.

Figure 5:
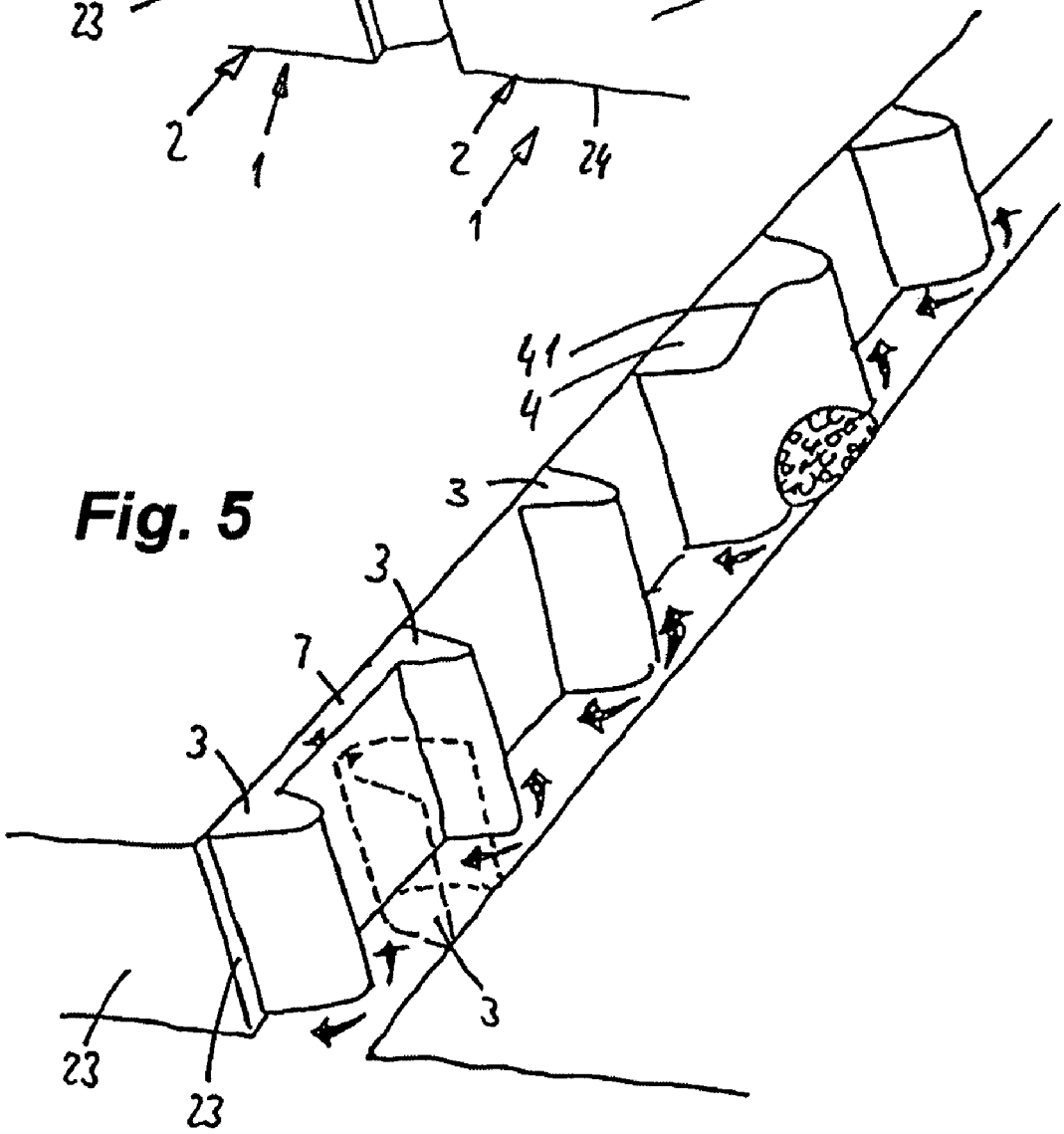
FIG. 5 shows the side flank of a paving stone with another design.
Figure 6:
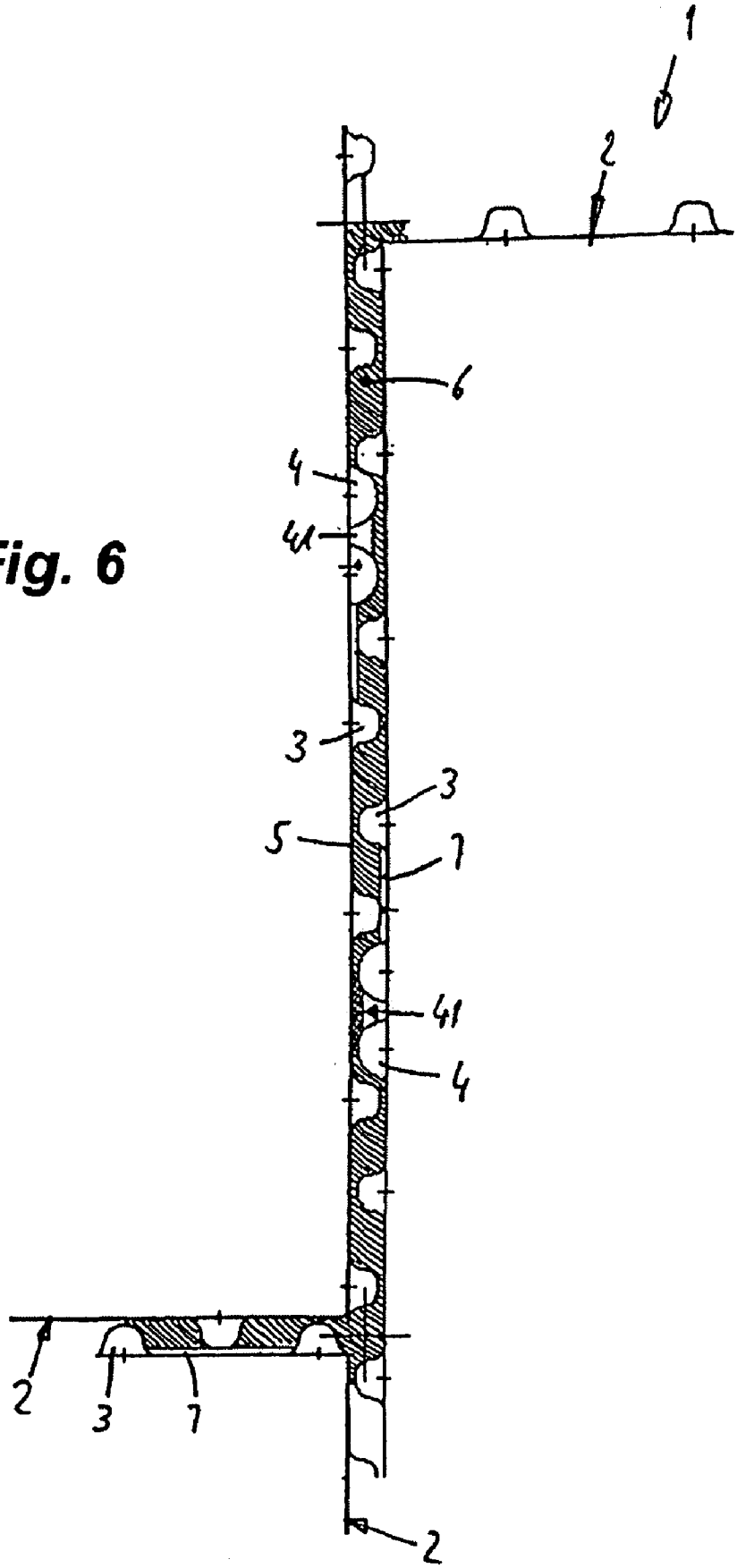
FIG. 6 shows a top view of the coupling of three adjacent paving stones.
Figure 7:
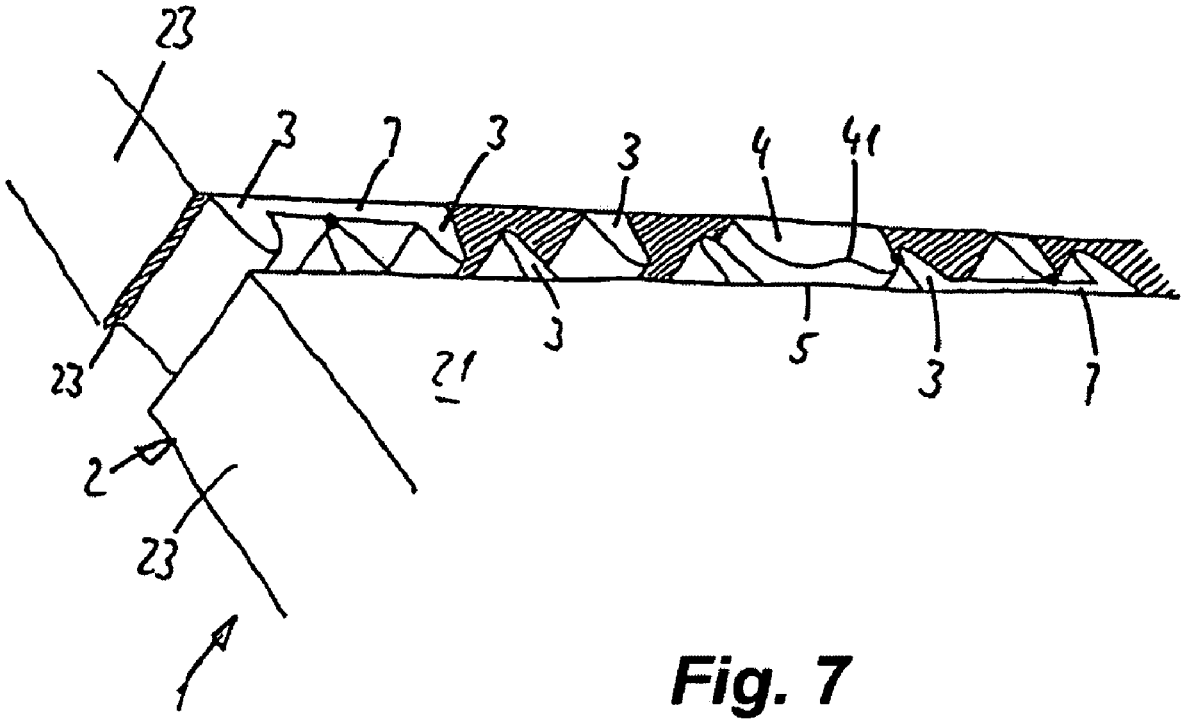
FIG. 7 is a perspective representation of the coupling of two mating stones with another design.

In the example according to FIG. 5 a thickening 7 is provided between two coupling members 3. This thickening 7 is in contact with a coupling member 3 of the adjacent paving stone and thus provides for a spacing of the two stones with respect to one another, which prevents contact of the remaining coupling members 3, 4 with the adjacent stone. This spacing represents the minimum joint width. One can take from FIG. 5 by means of the arrows how material is taken along from the pavement bedding when moving the paving stones 1 and is pushed laterally aside by the coupling members 3, 4. From this, another possibility for avoiding a direct contact of the stones ("concrete to concrete") results: the cavity 41 captures the material which would otherwise be pushed away laterally during moving the stones together. When sufficient filling material 6 has been accumulated in the cavity 41 of the wide coupling member 4 a pushing of one stone against the adjacent stone up to the contact "concrete to concrete" is prevented.

According to the inventive paving stone 1 at least on one side flank 23 a coupling member 4 is designed so wide that it completely fills the space between two adjacent coupling members 3 and 3 on the adjacent side flank 23 of the adjacent paving stone 1 with the necessary tolerance. As a result, a point-by-point fixation of the two adjacent paving stones with respect to one another is achieved. Simultaneously, this prevents dimensional differences or laying mistakes from several paving stones from accumulating and thus can result in an undesired position of the paving stones with respect to one another. Moreover, according to the invention lateral contact of coupling members, 3, 4 of adjacent paving stones 1 is reliably limited to only one point per stone flank 23.

The point-by-point fixation of two adjacent paving stones is with respect to one another prevents that a displacement of the stones with respect to one another caused by dimensional tolerances of the stones and undesired with respect to their target position results. Since such a displacement normally continues throughout several stones with the same tolerance normally a total appearance of the pavement which is not satisfying with regard to the design results. Even the effect of the coupling system can be endangered. This is prevented by the inventive design.

The invention claimed is:

1. A paving stone comprised of a polygonal body formed with:

substantially parallel upper and lower faces;

a plurality of substantially planar sides extending perpendicularly between the faces;

a row of substantially identical and outwardly projecting narrow coupling members all of a uniform predetermined member width on each of the sides and separated from one another by spaces of a predetermined uniform space width, the narrow coupling members being positioned on the respective sides such that when a plurality of the paving stones are fitted together with their upper faces generally coplanar the narrow coupling members of confronting sides of adjacent paving stones fit between one another; and a single wide coupling member on each of the sides and of a width greater than that of the uniform member width of the narrow members and smaller than the space width, the wide member being separated from adjacent narrow members on the respective side by the predetermined uniform space width, the wide member further being oriented such that when a plurality of the paving stones are fitted together with their upper faces generally coplanar the wide members fits between two of the narrow members of a confronting side of an adjacent paving stone and the narrow members on the confronting sides are out of contact with one another.

2. The paving stone defined in claim 1 wherein the wide and narrow members project outward the same distance from the respective sides.

3. The paving stone defined in claim 2 wherein the narrow members are of basically triangular section.

4. The paving stone defined in claim 2 wherein the wide members are each formed by a pair of semicylindrical ridges separated by a space narrower than the member width of the narrow members.

5. The paving stone according to claim 1 wherein the wide coupling members of opposite side flanks of the stone are diametrically disposed.

6. The paving stone according to claim 1 wherein each wide coupling member forms an outwardly open cavity.

7. The paving stone according to claim 1 wherein the lower face forms with the sides a sharp lower edge.

8. The paving stone according to claim 1 wherein the body is formed in at least one space between two of the narrow coupling members of each side with a thickening reducing a depth of the one space.

9. An array of substantially identical paving stones each having a polygonal body unitarily formed with:

substantially parallel upper and lower faces;

a plurality of substantially planar sides extending perpendicularly between the faces, the stones being arrayed with their upper faces substantially coplanar in a laying plane and with the sides of adjacent stones confronting and closely juxtaposed;

a row of substantially identical and outwardly projecting narrow coupling members of a predetermined uniform member width on each of the sides separated by spaces of a predetermined uniform space width, the narrow coupling members on confronting sides fitting between one another; and a single wide coupling member on each of the sides and of a width greater than that of the uniform member width of the narrow members and smaller than the uniform space width, the wide member being separated from adjacent narrow members on the respective side by the predetermined space width, the wide member further fitting between two of the narrow members of a confronting side of an adjacent paving stone and holding the narrow members of the confronting sides out of contact with one another.

* * * * *